US005226495A

United States Patent [19]

Jennings, Jr.

[11] Patent Number: 5,226,495

[45] Date of Patent: Jul. 13, 1993

[54] FINES CONTROL IN DEVIATED WELLS

[75] Inventor: Alfred R. Jennings, Jr., Plano, Tex.

[73] Assignee: Mobil Oil Corporation, Fairfax, Va.

[21] Appl. No.: 884,582

[22] Filed: May 18, 1992

[51] Int. Cl.[5] ..... E21B 43/04

[52] U.S. Cl. ..... 166/278

[58] Field of Search ..... 166/265, 266, 268, 276, 166/278, 380

[56] References Cited

U.S. PATENT DOCUMENTS

| | | | |
|---|---|---|---|
| 3,982,591 | 9/1976 | Hamrick et al. | 166/302 |
| 4,077,469 | 3/1978 | Hamrick et al. | 166/59 |
| 4,386,665 | 6/1983 | Dellinger | 175/61 |
| 4,570,710 | 2/1986 | Stowe | 166/250 |
| 4,623,021 | 11/1986 | Stowe | 166/278 X |
| 4,811,790 | 3/1989 | Jennings, Jr. et al. | 166/278 |

*Primary Examiner*—Ramon S. Britts
*Assistant Examiner*—Roger J. Schoeppel
*Attorney, Agent, or Firm*—Alexander J. McKillop; George W. Hager, Jr.

[57] ABSTRACT

This specification relates to the control of earth fines that are produced with hydrocarbons from a hydrocarbon-bearing formation into a well that penetrates the hydrocarbon-bearing formation. More particularly this specification relates the control of fines from a heavy-oil reservoir that is stimulated by thermal techniques and penetrated by and in communication with a well that is highly deviated from the vertical.

6 Claims, 1 Drawing Sheet

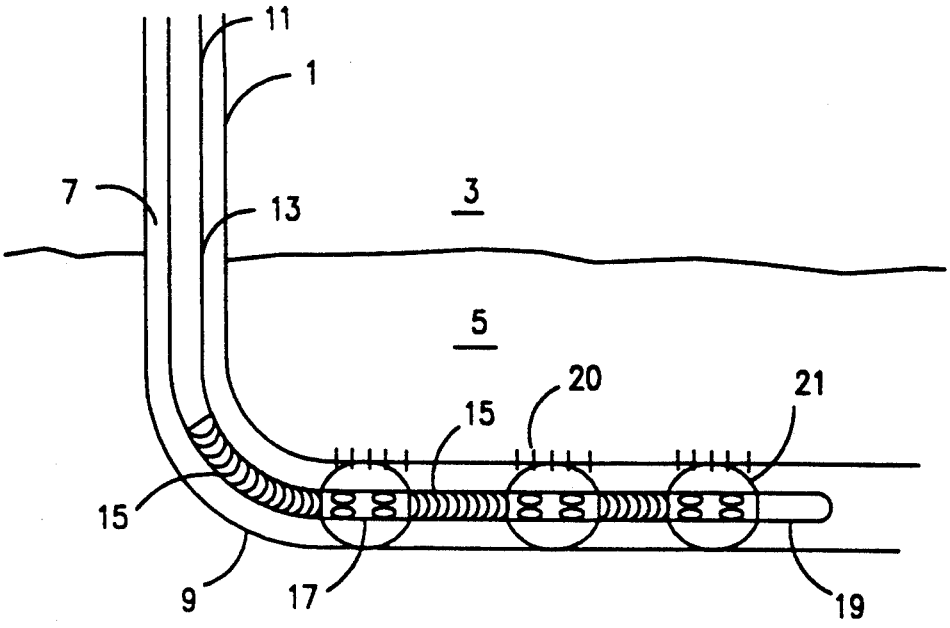
FIG. 2
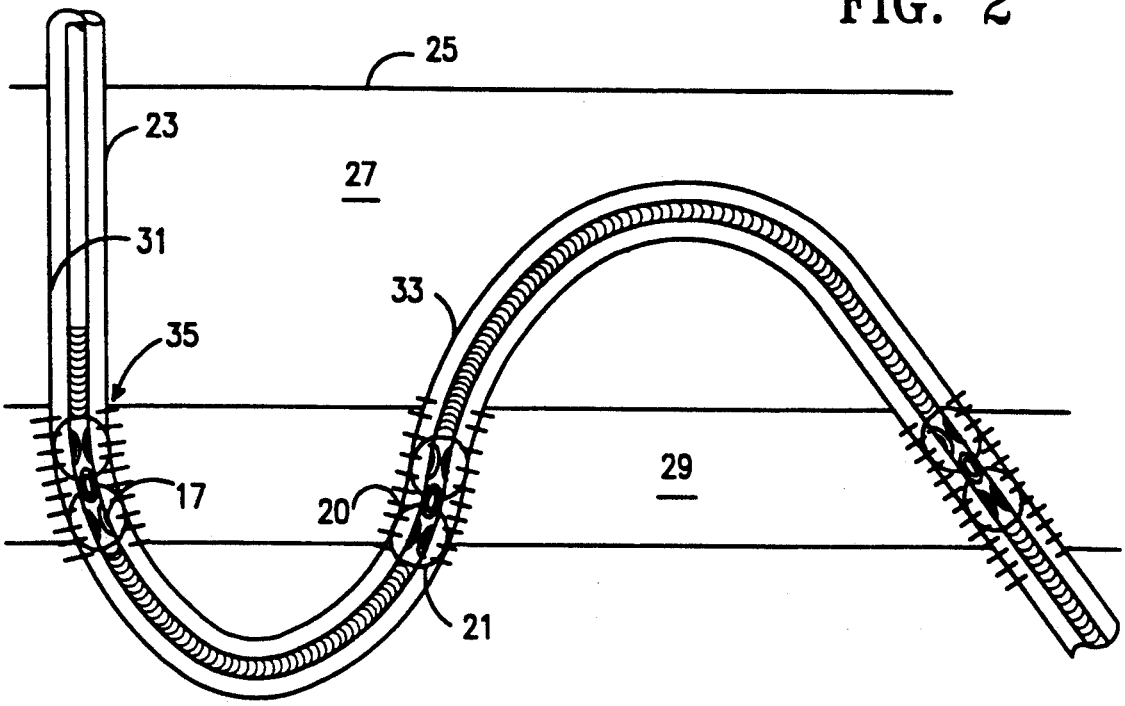

FINES CONTROL IN DEVIATED WELLS

FIELD OF THE INVENTION

This invention relates to a method and system for controlling the amount of formation fines that are produced from a heavy oil reservoir that is stimulated by thermal means and is penetrated by and in communication with a well that is highly deviated from the vertical.

BACKGROUND OF THE INVENTION

This invention is concerned with producing hydrocarbons from hydrocarbon-bearing formations. More particularly it is concerned with controlling the amount of particulate matter, often referred to as sand, formation fines, or fines which are produced along with hydrocarbons from a hydrocarbon-bearing formation into a well that penetrates and communicates with the hydrocarbon-bearing formation.

There are many methods and equipment available for reducing or preventing the production of fines along with fluids and in particular along with hydrocarbons that are produced from earth formations into a well that penetrates the formation. Such methods and equipment include the use of sand screens, filters, perforated liners and slotted liners. Such equipment may be subjected to high temperatures and fluids having low and/or high pH values. Such conditions are encountered particularly when fluids are produced from hydrocarbon-bearing formations that are stimulated by thermal recovery techniques, such as steam and fire secondary and tertiary techniques. Also, fluids such as acids are often injected down a well and out through such equipment and into the formation to clean the equipment and/or the formation that communicates with the well.

A device for controlling the production of fines into a well is described in U.S. Pat. No. 4,811,790 which device is resistant to shock and which can withstand harsh conditions encountered with thermal enhanced oil recovery techniques. This device is referred to hereafter as a "refractory tube".

SUMMARY OF THE INVENTION

This invention is directed to a method and system for controlling the production of fines from a heavy oil reservoir that is stimulated by thermal means and which reservoir is penetrated by a wellbore. A wellbore is formed which has a first portion that extends essentially vertically from a surface location into the earth's crust, and a second portion that extends from the first portion and is deviated from the first portion at an angle of sixty degrees or greater which second portion extends into the heavy oil reservoir. The wellbore is thereafter cased to provide a well for producing hydrocarbons from the reservoir. A production string is extended down the well which production string has a first vertical portion and a second portion connected to the lower end of the first portion. The second portion of the production string is formed of flexible tubing and is deviated to conform with the second portion of the wellbore and has connected therein at least one refractory tube.

BRIEF DESCRIPTION OF THE DRAWINGS

FIG. 1 illustrates an embodiment of this invention for controlling fines produced into a highly deviated well.

FIG. 2 is a schematic view illustrating other embodiments of the invention.

DESCRIPTION OF THE PREFERRED EMBODIMENTS

This invention is directed to a technique of completing a wellbore that is drilled into a hydrocarbon reservoir to control or reduce the amount of formation fines, sometime referred to as fines or sand, that is produced or transported along with fluids from the reservoir into the wellbore. More particularly this invention is directed to controlling the production of fines from a heavy oil reservoir that is stimulated by thermal means and which reservoir is penetrated by a wellbore completed as a well that is deviated from the vertical at an angle of sixty degrees or greater.

Earth formations which contain viscous hydrocarbons are often referred to as heavy oil reservoirs. Such heavy oils often have an API gravity less than 15 and have a viscosity that is sufficiently high that production of such heavy oils from the reservoir without assistance by some secondary recovery means is difficult and slow and may be uneconomical. Thermal secondary recovery means is often used inasmuch as heat, which may be introduced, for example, by injecting steam into the reservoir or conducting a fire flood both lowers the viscosity of the heavy oil and provides secondary energy that assists in producing the heavy oil from the reservoir into a well.

For a more detailed description of the invention reference is made to FIG. 1 wherein there is shown a schematic view of a wellbore 1 that is extended through overburden earth formations 3 and penetrates a heavy oil reservoir 5. A first portion 7 of the wellbore 1 is shown schematically extending essentially vertically from the earth's surface (not shown) and a second portion 9 of the wellbore 1 extending from the first portion 7 at an angle of 60 degrees or greater into the heavy oil reservoir 5. In FIG. 1 the second portion 9 of the wellbore 1 is shown extending from the first portion 7 an an angle of about 90 degrees into the heavy oil reservoir 5. This configuration is sometimes referred to as a horizontal well. Within wellbore 1 there is shown a production or tubing string 11 that extends down the vertical portion of the wellbore and into the second deviated portion of the wellbore. The production string is comprised of a first vertical portion 13 and a second deviated portion 15. The second deviated portion 15 of the production string is formed of flexible tubing. Suitable flexible tubing that can be used in accordance with this invention is marketed under the name of COFLEXIP and can be obtained through Coflexip & Services Inc., 7660 Woodway, Suite 390, Houston, Tx 77063. The second deviated portion of the production string has at least one refractory tube 17 connected thereto through which hydrocarbons can flow from the heavy oil reservoir 5 into the production string 11 through perforations 20 and be produced to the surface of the earth and recovered. A guide shoe 19 will normally be connected to the lower end of the second deviated portion of the production string to seal the lower end thereof such that fluids that flow from the heavy oil reservoir into the wellbore will flow through the refractory tube to enter the production string. The second deviated portion of the production string ma be made up of multiple refractory tubes interconnected by flexible tubing in order to efficiently produce the heavy oil reservoir.

The wellbore 1 will normally be cased and completed in a conventional manner. Centralizers such as bow spring centralizers 21 will normally be used to space the production tubing from the well or casing wall.

With reference to FIG. 2 there is provided a schematic illustration of other embodiments of this invention. A wellbore 23 is shown extending from the earth's surface 25 through earth overburden 27 and penetrating a heavy oil reservoir 29. The first portion 31 of the wellbore 23 extends essentially vertically from the earth's surface to a kickoff point 35 where a second portion 33 of the wellbore deviates from the first portion 31 at an angle of 60 degrees or more. The second portion 33 of the wellbore extends into the heavy oil reservoir 29 and is deviated at a sufficiently high angle such that it exits through the uppermost portion of the heavy oil reservoir and into the earth overburden 27 where it is then deviated downward to repenetrate the heavy oil reservoir 29 and extend therethrough and may exit the lower portion of the heavy oil reservoir. A method of providing such a wellbore is shown in U.S. Pat. No. 4,386,665 and the subject matter thereof is incorporated herein by reference. In accordance with this invention the wellbore 23 is completed by using flexible tubing with refractory tubes interspersed therein as previously described with reference to FIG. 1.

What is claimed is:

1. A method of controlling the production of fines with hydrocarbons produced from a heavy oil reservoir that is stimulated by thermal means and which reservoir is penetrated by a wellbore comprising:

(a) forming a first portion of said wellbore which extends essentially vertically from a surface location into the earth's crust;

(b) forming a second portion of said wellbore that extends from said first portion and is deviated from said first portion at an angle of sixty degrees or greater, said second portion extending into said heavy oil reservoir;

(c) completing and casing said wellbore to provide a well for producing hydrocarbon from said reservoir;

(d) extending a production string down said well, said production string having a first vertical portion and having a second portion connected to the lower end of said first portion, said second portion being conform with said second portion of said wellbore and having connected therein at least one refractory tube.

2. The method of claim 1 wherein in step (d) said second portion of said production string is comprised of a first flexible tubing section connected with said first portion of said drill string, a first refractory tube connected with said first tubing section, a second flexible tubing section connected with said first refractory tube, and a second refractory tube connected with said second flexible tubing section, said second portion of said production string being sealed at its terminal end such that fluids entering the production string from the reservoir do so through said first and second refractory tubes.

3. The method of claim 2 wherein said second portion of said production string is comprised of three or more combinations of flexible tubing sections and refractory tubes.

4. The method of claim 3 wherein said second portion of said wellbore is deviated from said first portion at an angle of eighty degrees or greater.

5. The method of claim 4 wherein said second portion of said wellbore is deviated from said first portion at an angle of ninety degrees or greater.

6. A method of controlling the production of fines with hydrocarbons produced from a heavy oil reservoir that is stimulated by thermal means and which reservoir is penetrated by a wellbore comprising:

(a) forming a first portion of said wellbore to extend essentially vertically from said surface location into said earth's crust:

(b) forming a second portion of said wellbore that is deviated from said first portion and extends from the lower end of said first portion through the upper boundary of said subsurface hydrocarbon-bearing formation and into the earth's crust therebelow, said second portion of said wellbore upon passing said upper boundary of said hydrocarbon-bearing formation making an angle with the vertical within the range of 60 degrees to 80 degrees:

(c) forming a third portion of said wellbore that extends from the lower end of said second portion and is deviated and extended in an upwardly direction through the lower boundary of said hydrocarbon-bearing formation and into said hydrocarbon-bearing formation:

(d) completing and casing said wellbore to provide a well for producing hydrocarbons from said reservoir;

(e) extending a production string down said well, said production string having a first vertical portion, a second flexible portion, and a third flexible portion, wherein when said production string is extended to essentially the full length of the well, said first vertical portion is located within said first vertical portion of said well, said second flexible portion is located within said second portion of said well and said third flexible portion is located within said third portion of said well, and wherein said second flexible portion is formed of a second flexible tubing connected to the lower end of said first vertical portion and one or more refractory tubes connected into or interspersed into and along the length of said second flexible portion, and wherein said third flexible portion is formed of a third flexible tubing connected to the lower end of said second flexible portion and one or more refractory tubes connected into or interspersed into and along the length of said third flexible portion.

* * * * *

UNITED STATES PATENT AND TRADEMARK OFFICE

CERTIFICATE OF CORRECTION

PATENT NO. : 5,226,495

DATED : July 13, 1993

INVENTOR(S) : Jennings

It is certified that error appears in the above-indentified patent and that said Letters Patent is hereby corrected as shown below:

Col. 3, line 48, before "conform" insert --formed of flexible tubing and being deviated to--

Signed and Sealed this

Tenth Day of May, 1994

Bruce Lehman

*Attest:*

BRUCE LEHMAN

*Attesting Officer*

*Commissioner of Patents and Trademarks*